US008100056B2

(12) United States Patent
Kuhlmeyer et al.

(10) Patent No.: US 8,100,056 B2
(45) Date of Patent: Jan. 24, 2012

(54) METHOD FOR CONTROLLING A PROCESSING MACHINE FOR SHEET MATERIAL

(75) Inventors: Lothar Kuhlmeyer, Darmstadt (DE); Bernd Lindner, Heusenstamm (DE); Bernd Marneth, Gross-Zimmern (DE); Jurgen Schunk, Mainz (DE); Holger Wiese, Obertshausen (DE)

(73) Assignee: manroland AG, Offenbach (DE)

( * ) Notice: Subject to any disclaimer, the term of this patent is extended or adjusted under 35 U.S.C. 154(b) by 764 days.

(21) Appl. No.: 12/158,864

(22) PCT Filed: Dec. 9, 2006

(86) PCT No.: PCT/EP2006/011877
§ 371 (c)(1),
(2), (4) Date: Sep. 19, 2008

(87) PCT Pub. No.: WO2007/073851
PCT Pub. Date: Jul. 5, 2007

(65) Prior Publication Data

US 2009/0071360 A1 Mar. 19, 2009

(30) Foreign Application Priority Data

Dec. 24, 2005 (DE) ..... 10 2005 062 373

(51) Int. Cl.
*B41F 33/00* (2006.01)
*B41F 35/00* (2006.01)

(52) U.S. Cl. ..... 101/483; 101/335; 101/423; 101/425

(58) Field of Classification Search ..... 101/483, 101/335, 423–425
See application file for complete search history.

(56) References Cited

U.S. PATENT DOCUMENTS 4,000,691 A 1/1977 Fischer
4,270,450 A * 6/1981 Difflipp et al. ..... 101/142
5,826,505 A 10/1998 Volz et al.
5,927,195 A 7/1999 Volz et al.

(Continued)

FOREIGN PATENT DOCUMENTS

DE 19623224 C1 9/1997

(Continued)

*Primary Examiner* — Ren Yan
*Assistant Examiner* — David Banh
(74) *Attorney, Agent, or Firm* — Leydig, Voit & Mayer, Ltd.

(57) ABSTRACT

The invention relates to a method for controlling a machine processing sheet material. The processing machine has at least one printing or coating group and a cylinder that is coupled to a direct drive and is decoupled mechanically from a main drive acting on a gear train of a plurality of sheet transport cylinders and that can be driven in a given way at least relative to the sheet-guiding cylinders. The cylinder having an associated inking group with an inking group roller that can be driven by the main drive and gear train. Printing contact in a contact zone of the cylinder carrying the printing form with an adjacent rubber blanket cylinder is cancelled for cleaning. The inking group roller of the inking group is separated on a drive side from the sheet transport cylinders driven by the main drive and gear train. The inking group roller is coupled on the drive side to the cylinder carrying the printing form. The inking group roller is driven according to a cleaning program stored in a selection menu for an individual cleaning period at an individual rotational speed by the direct drive.

8 Claims, 2 Drawing Sheets

U.S. PATENT DOCUMENTS

| | | | | |
|---|---|---|---|---|
| 5,964,157 | A | 10/1999 | Hummel et al. | |
| 5,983,793 | A | 11/1999 | Volz et al. | |
| 6,546,869 | B1 | 4/2003 | Eltner et al. | |
| 6,588,337 | B1 * | 7/2003 | Kreckel et al. | 101/424 |
| 6,883,427 | B2 * | 4/2005 | Price et al. | 101/423 |
| 2003/0172818 | A1 * | 9/2003 | Motard | 101/148 |
| 2004/0050272 | A1 * | 3/2004 | Detmers et al. | 101/216 |
| 2004/0103803 | A1 | 6/2004 | Price et al. | |
| 2007/0289465 | A1 | 12/2007 | Wiese et al. | |
| 2008/0000376 | A1 | 1/2008 | Wiese et al. | |
| 2011/0069102 | A1 * | 3/2011 | Horade et al. | 347/16 |

FOREIGN PATENT DOCUMENTS

| | | | |
|---|---|---|---|
| DE | 19650075 | A1 | 6/1998 |
| DE | 10000903 | A1 | 8/2000 |
| DE | 102004039588 | | 2/2006 |
| EP | 0812683 | | 12/1997 |
| EP | 0834398 | A1 | 4/1998 |
| EP | 0858891 | A1 | 8/1998 |
| WO | 2006/018105 | A2 | 2/2006 |
| WO | 2006/018106 | A1 | 8/2006 |

* cited by examiner

METHOD FOR CONTROLLING A PROCESSING MACHINE FOR SHEET MATERIAL

CROSS-REFERENCE TO RELATED APPLICATIONS

This patent application is the national phase of PCT/EP2006/011877, filed Dec. 9, 2006, which claims the benefit of German Patent Application No. 102005062373.5, filed Dec. 24, 2005, which is incorporated herein by reference.

BACKGROUND OF THE INVENTION

A processing machine with a controllable direct drive for an individually drivable cylinder is known from EP 0 812 683 A1. A plate cylinder or a rubber blanket cylinder, which can be driven directly by an individual drive, of at least one printing group is decoupled from a gear train of a sheet-fed offset printing group provided for the transport of sheet material by sheet-guiding cylinders. Due to the plate cylinders, which can be driven directly by a motor individually and independently of the other cylinders, processes such as plate exchange or cylinder cleaning are also possible in addition to pressure-related correction. The inking group allocated to the plate cylinder has at least one roller, which can be driven with a direct motor drive. Alternatively, certain inking group rollers are coupled on the drive side to the gear train for sheet transport by the main drive.

Additionally, a method for controlling a processing machine for sheet material is disclosed in DE 10 2004 039 588. For cleaning operations, the cylinder carrying the printing form and the adjacent inking group/dosing device in a printing/coating group are driven temporarily at a first rotational speed in sync by an individual drive (direct drive) driven by a separate motor. In contrast, the rubber blanket cylinder and the sheet-guiding cylinder (printing cylinder) in a printing group or the sheet-guiding cylinder (printing cylinder) in a coating group is driven at a second rotational speed (in sync) by the main drive and gear train.

BRIEF SUMMARY OF THE INVENTION

A general object of the present invention is providing a method of the type described above, which noticeably reduces the effort needed for cleaning in an inking group or a dosing device of a processing machine for sheet material that has at least one cylinder that can be driven individually and that carries a printing form.

A first advantage of the invention consists in that a clear reduction of the cleaning effort is realized by the individual cleaning period and also the individual rotational speeds of the rollers or cylinders to be cleaned, in particular, for the cleaning of an inking group and/or a dosing device on a processing machine.

A second advantage is that each inking group or each dosing device, driven at individual rotational speeds, can be cleaned with a cleaning program stored in a selection menu over an individual cleaning period. The cleaning program also stores the printing ink or coating used in each printing or coating group (in an ink-specific or coating-specific way) and takes it into consideration in the cleaning period or the rotational speed. Furthermore, criteria relevant to each printing/coating task can be stored in the cleaning program.

A third advantage is that the roller wear can be noticeably reduced by the individual cleaning period and individual rotational speeds. Thus, for example, printing/coating groups that are only slightly contaminated can be cleaned in a shorter time than was previously possible through common cleaning of the rollers by the main drive and gear train.

The invention will be explained in more detail using an illustrative embodiment.

DETAILED DESCRIPTION OF THE INVENTION

Figure 1:
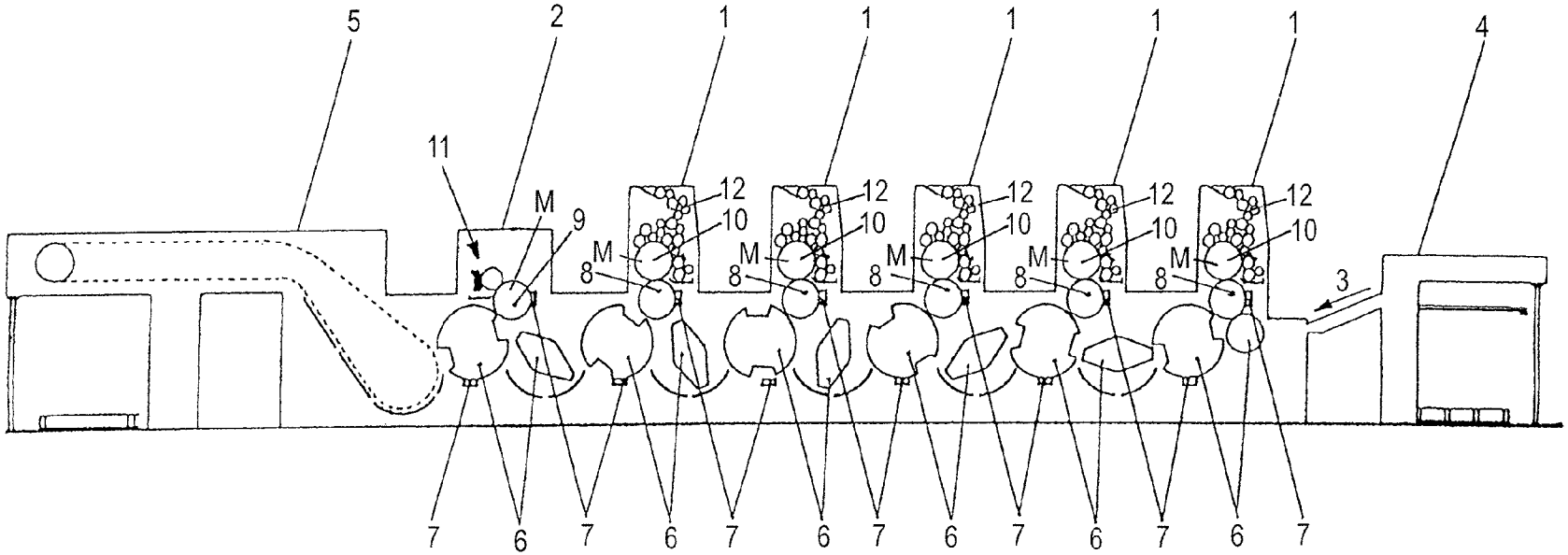
FIG. 1 is a schematic side view of a sheet-fed rotary printing machine with several printing groups and a coating group.

A sheet-fed rotary printing machine illustrated in FIG. 1 includes a feeder 4, five offset printing groups 1, a coating group 2, and a sheet delivery unit 5. In a known manner, each offset printing group 1 has an inking group 12 with inking group rollers, a cylinder 10 carrying a printing form, a plate cylinder 10, and a rubber blanket cylinder 8. If necessary, a dampening group is allocated to each plate cylinder 10.

The coating group 2 has, in a known way, a dosing device 11 for the medium (coating, ink) to be processed (preferably a chamber doctor blade with an allocated, screened application roller or a roller system with an application roller) and a cylinder 9 carrying a printing form, in this case a form cylinder 9. In the present example, the coating group 2 is arranged after the offset printing groups 1 in the transport direction 3 of the sheet material.

The plate cylinder 10 and form cylinder 9 each carry at least one printing form and the ink application rollers of the inking group 12 or the application roller of the dosing device 11 can be brought into contact with the corresponding plate/form cylinder 10, 9. In one improvement, at least one dampening application roller of the dampening group can be brought in contact with the plate cylinder 10. Several sheet-guiding cylinders 6 are provided for sheet transport in a transport direction 3. In each printing or coating group 1, 2, there is a sheet-guiding cylinder 6 constructed as a printing cylinder in functional connection with the rubber blanket cylinder 8 or form cylinder 9. In the first printing group 1, a contact drum as a sheet-guiding cylinder 6 is arranged before the sheet-guiding cylinder 6 constructed as a printing cylinder. For sheet transport, additional sheet-guiding cylinders 6 are arranged as transfer cylinders between the sheet-guiding cylinders 6 constructed as printing cylinders in the printing or coating groups 1, 2.

A cleaning device 7 (cloth or brush washing device or a non-contact printing-plate cleaning device) is allocated to each rubber blanket cylinder 8, form cylinder 9, and sheet-guiding cylinder 6 advantageously constructed as a printing cylinder. Each inking group 12 has an inking group washing device (e.g., a washing agent spraying system directed onto the roller train) and also an adjustable doctor blade device on the last inking group roller in the rotational direction of the plate cylinder 10. If necessary, another cleaning device is allocated to the application roller or the application roller can be cleaned by the chamber doctor blade.

Figure 2:
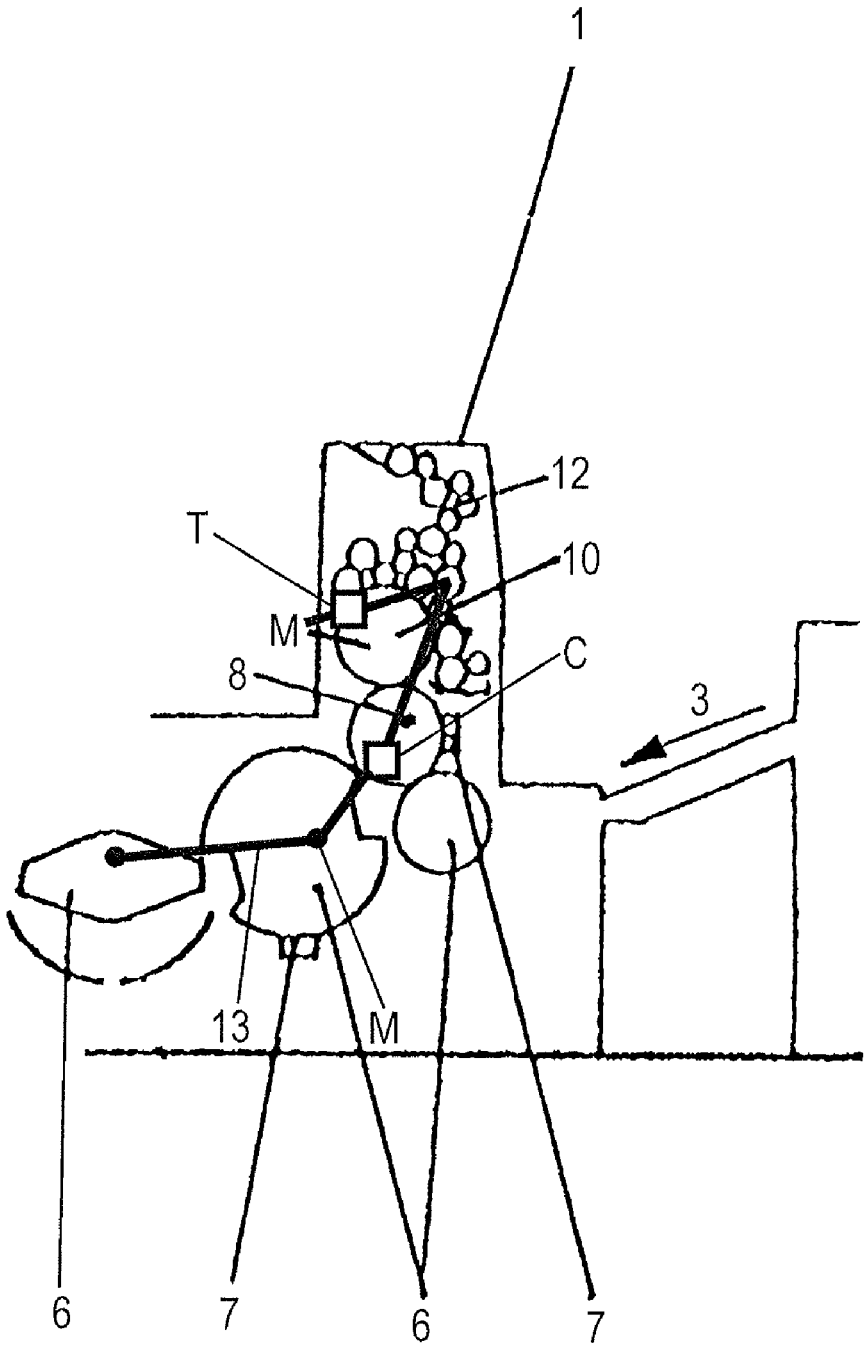
FIG. 2 is a more detailed schematic view of one of the printing groups of the illustrated printing machine.

At least all of the sheet-guiding cylinders 6 are coupled to each other on the drive side by a main drive D (at least one feeding drive motor) and a gear train 13. As depicted in FIG. 2, each plate cylinder 10 and preferably each form cylinder 9 can be driven by a separate motor—decoupled mechanically from the main drive and gear train—via a direct drive M, i.e., a separate drive motor. These direct drives M are coupled to a machine controller and can be driven individually in a given way at least relative to the sheet-guiding cylinders 6 (main drive and gear train).

An example of a method for controlling at least one advantageously offset printing group 1 of a processing machine for sheet material is described below. In the example, the cylinder 10, in this case a plate cylinder 10 which is supported in side frames and carries a printing form, is coupled to a direct drive M and mechanically decoupled from a main drive acting on the gear train of the sheet-guiding cylinder 6 for sheet transport and can be driven in a given way at least relative to the sheet-guiding cylinders 6. An inking group 12 that has at least one inking group roller that can be driven by the main drive D and gear train 13 is allocated to the directly driven plate cylinder 10. The inking group roller is preferably an inking friction roller that can be driven rotationally and variably in the axial direction. If necessary, a drive-side coupling can be realized with other inking group rollers.

In a contact zone of the directly driven cylinder 10 that carries the printing form and is constructed as a plate cylinder 10 of the offset printing group 1, the printing contact at an adjacent rubber blanket cylinder 8 is canceled. For cleaning, the inking group rollers of the inking group 12, (i.e., at least the inking friction roller named above) are separated or decoupled by a coupling C on the drive side from the sheet-guiding cylinders 6 driven by the main drive the main drive and gear train. The inking group rollers of the inking group 12 are coupled temporarily on the drive side (i.e., for the cleaning period) with the plate cylinder 10 by a temporary coupling T driven by the direct drive M and carrying the printing form.

At least one inking group roller or the inking group rollers of the inking group 12 are then driven according to a cleaning program stored in a selection menu for an individual cleaning period at individual rotational speeds by a direct drive M. Preferably, the cleaning is performed by a known inking group washing device.

The temporary drive coupling T between the directly driven plate cylinder 10 and the inking group rollers of the inking group 12 is then separated and the inking group rollers of the inking group 12 are coupled to the main drive M and gear train 13 of the sheet-guiding cylinder 6 and the printing contact between the plate cylinder 10 and the rubber blanket cylinder 8 is reproduced.

In a first improvement, the inking group rollers to be cleaned, especially the application rollers, of the inking group 12 are set on the directly driven plate cylinder 10 and the inking group rollers of the inking group 12 and the plate cylinder 10 are driven in sync according to a cleaning program stored in a selection menu for an individual cleaning period at individual rotational speeds.

In a second improvement, the inking group rollers to be cleaned, especially the application rollers, of the inking group 12 are set away from the directly driven plate cylinder 10 and only the inking group rollers of the inking group 12 are driven according to a cleaning program stored in a selection menu for an individual cleaning period at individual rotational speeds.

The cleaning program includes at least one washing sequence with the following processing steps:

a defined quantity of cleaning agent (cleaning solution and/or water) is sprayed onto the roller train of the inking group 12 by a spraying device;

the cleaning agent is then distributed by the inking group rollers driven by the direct drive M and the printing ink is dissolved until a flowable emulsion of printing ink and cleaning agent exists on the roller surfaces; and a doctor blade device is then set periodically on an inking group roller and the emulsion of ink and cleaning agent is scraped off.

The distribution of the cleaning agent and also the scraping are performed while the rollers are rotating. In one refinement, the doctor blade device can be set periodically on an inking group roller within a washing sequence.

In another refinement, at least for cleaning the rubber blanket cylinder 8 and/or the adjacent sheet-guiding cylinder 6, these cylinders are driven by the main drive and gear train according to a cleaning program stored in a selection menu for an individual cleaning period at a rotational speed that differs for the inking group 12 and for the directly driven plate cylinder 10. This can be performed simultaneously for cleaning the inking group rollers.

Additionally, after the cleaning of the inking group rollers (without the plate cylinder 10) or the inking group rollers and the plate cylinder 10 has ended, the inking group rollers and the plate cylinder 10 are driven in sync by the direct drive M at the machine speed generated by the main drive and then the temporary drive coupling between the directly driven plate cylinder 10 and the inking group rollers of the inking group 12 is separated and then the inking group rollers of the inking group 12 are coupled to the main drive and gear train of the sheet-guiding cylinder 6 during the cleaning of the rubber blanket cylinder 8 at the machine speed. Preferably, this process is performed at a time at which the rubber blanket cylinder 8 has essentially already been cleaned.

In another design, at least one dampening group roller to be cleaned in a dampening group can be set on the directly driven plate cylinder 10 and the dampening group rollers of the dampening group and the plate cylinder 10 are driven in sync according to a cleaning program stored in a selection menu for an individual cleaning period at individual rotational speeds.

In another design, at least one dampening group roller to be cleaned in a dampening group can be set on an inking group roller of the inking group 12 and the dampening group rollers are driven in sync according to a cleaning program stored in a selection menu for an individual cleaning period at individual rotational speeds. Preferably, a coupling of the dampening group rollers with the inking group rollers is realized by a bridge roller. The dampening group rollers and also the inking group rollers are in this case separated from the plate cylinder 10 (no contact).

In another refinement, while the doctor blade device is set on an inking group roller, the emulsion of printing ink and cleaning agent can be scraped off and a defined quantity of cleaning agent can be sprayed onto the roller train.

LIST OF REFERENCE SYMBOLS

1. Offset printing group
2. Coating group
3. Transport direction
4. Feeder
5. Sheet delivery
6. Sheet-guiding cylinder
7. Cleaning device
8. Rubber blanket cylinder
9. Cylinder/form cylinder carrying a printing form
10. Cylinder/plate cylinder carrying a printing form
11. Dosing device
12. Inking group
13. Direct drive

The invention claimed is:

1. A method for controlling a sheet material processing machine having at least one printing or coating group having a blanket cylinder and an adjacent cylinder carrying a printing form that is coupled to a direct drive and is decoupled mechanically from a main drive acting on a gear train of a plurality of sheet transport cylinders, said printing form carrying cylinder having an associated inking group with an inking group roller that can be driven by the main drive and gear train, comprising the steps of:

exclusively driving the printing form carrying cylinder by the direct drive during a printing operation of the machine;

interrupting printing contact in a contact zone of the printing form carrying cylinder with the adjacent blanket cylinder for cleaning;

decoupling the inking group roller of the inking group on a drive side from the main drive and gear train for the sheet transport cylinders;

coupling the inking group roller on the drive side to the direct drive for the printing form carrying cylinder;

driving the inking group roller according to a cleaning program stored in a selection menu for an individual cleaning period at an individual rotational speed by the direct drive;

decoupling the inking group roller from the direct drive for printing form carrying cylinder following the cleaning period;

recoupling the inking group roller to the main drive and gear train and reestablishing printing contact between the printing form carrying cylinder following the cleaning period.

2. The method according to claim 1, wherein the inking group roller to be cleaned is set in contact with the printing form carrying cylinder and the inking group roller and the printing form carrying cylinder are driven in sync according to the cleaning program.

3. The method according to claim 1, wherein the inking group roller to be cleaned is set away from the printing form carrying cylinder and only the inking group roller is driven according to the cleaning program.

4. The method according to claim 1, further including the step of setting at least one dampening group roller to be cleaned in a dampening group in adjacent contact with the printing form carrying cylinder while the dampening group roller and the printing form carrying cylinder are driven in sync according to a cleaning program stored in a selection menu for an individual cleaning period at an individual rotational speed.

5. The method according to claim 1, further including the step of setting at least one dampening group roller to be cleaned in a dampening group on the inking group roller with the dampening group roller and the inking group roller being driven in sync according to the cleaning program.

6. The method according to claim 1, wherein the cleaning program includes at least one washing sequence with the following processing steps:

spraying a defined quantity of cleaning agent onto a roller train of the inking group;

distributing the cleaning agent via the inking group roller such that printing ink is dissolved and a flowable emulsion of printing ink and cleaning agent is produced on the roller surface; and setting a doctor blade device on the inking group roller so as to scrape off the emulsion of printing ink and cleaning agent.

7. The method according to claim 6, wherein the doctor blade device is set periodically on the inking group roller within the washing sequence.

8. The method according to claim 6, wherein while the doctor blade device is set on the inking group roller the emulsion of printing ink and cleaning agent is scraped off and also the defined quantity of cleaning agent is sprayed onto the roller train.

* * * * *